United States Patent [19]

Muller et al.

[11] Patent Number: 4,949,696

[45] Date of Patent: Aug. 21, 1990

[54] CAPACITOR IGNITION SYSTEMS

[75] Inventors: Michael Muller; Werner Erhardt, both of Cadolzburg, Fed. Rep. of Germany

[73] Assignee: Prufrex-Electro-Apparatebau, Cadolzburg, Fed. Rep. of Germany

[21] Appl. No.: 334,933

[22] Filed: Apr. 7, 1989

[30] Foreign Application Priority Data

May 20, 1988 [DE] Fed. Rep. of Germany ..... 3817187

[51] Int. Cl.[5] ..... F02P 1/00

[52] U.S. Cl. ..... 123/601; 123/600

[58] Field of Search ..... 123/600, 601, 149 C, 123/618

[56] References Cited

U.S. PATENT DOCUMENTS

| | | | |
|---|---|---|---|
| Re. 31,837 | 2/1985 | Burson | 123/601 |
| 3,500,809 | 3/1970 | Hohne et al. | 123/600 |
| 3,545,420 | 12/1970 | Foreman et al. | 123/600 |
| 3,703,889 | 11/1972 | Bodig et al. | 123/600 |
| 3,941,111 | 3/1976 | Carmichael et al. | 123/600 |
| 3,955,549 | 5/1976 | Burson | 123/600 |
| 3,960,128 | 6/1976 | Anderson et al. | 123/600 |
| 4,033,311 | 7/1977 | Burson | 123/600 |
| 4,036,201 | 7/1977 | Burson | 123/600 |
| 4,056,088 | 11/1977 | Carmichael | 123/600 |
| 4,170,977 | 10/1979 | Carmichael et al. | 123/600 |
| 4,181,114 | 1/1980 | Carlsson et al. | 123/600 |
| 4,232,646 | 11/1980 | Asai | 123/600 |
| 4,285,321 | 8/1981 | Phelon et al. | 123/600 |
| 4,611,569 | 9/1986 | Kondo et al. | 123/600 |

*Primary Examiner*—Raymond A. Nelli

*Attorney, Agent, or Firm*—Neuman, Williams, Anderson & Olson

[57] ABSTRACT

Capacitor ignition systems for internal combustion engines in which a charging winding forms part of an ignition coil and a primary winding is connected in circuit with the charging winding to contribute to capacitor charging. In one embodiment, the secondary winding is also connected in circuit with the charging winding which contributes to development of an output voltage. Circuit components are provided for insuring a high output voltage while protecting a charging diode against excessive inverse voltage during ignition and for protecting the gate of a thyristor switch from an excessive negative voltage.

9 Claims, 3 Drawing Sheets

CAPACITOR IGNITION SYSTEMS

BACKGROUND OF THE INVENTION

1. Field of the Invention

This invention relates to capacitor ignition systems and more particularly to ignition systems for internal combustion engines including devices with windings on iron cores and associated circuit components charge a capacitor from a the field of a rotating magnet and subsequently discharge the capacitor to develop a high ignition voltage. The system of the invention has excellent performance characteritics and it is efficient and highly reliable and trouble-free in operation while being readily and economically manufacurable.

2. Background of the Prior Art

There are a number of disclosures in the prior art of capacitor ignition systems which charge a capacitor from the field of a rotating magnet and then discharge the capacitor to develop a high ignition voltage. Various types of coil arrangements are disclosed for performing charging and ignition functions. For example, the Foreman et al. U.S. Pat. No. 3,545,420 discloses arrangements in which two coils perform such functions, one coil serving as both a charging coil and as a secondary ignition coil and a second coil operating solely as a primary ignition coil through which the capacitor is discharged. In one arrangement, a trigger signal is obtained from a separate trigger coil and in another, a trigger signal isr obtained from the coil which serves as both the charging coil and the secondary ignition coil. The Burson U.S. Pat. No. 4,036,201 and the Burson U.S. Pat. No. Re. 31,837 disclose arrangement in which the charging and ignition functions are performed by three coils. A primary ignition coil, also serving as a trigger coil, is connected in series with an electronic switch and in parallel relation to a charging capacitor, while a charging coil is connected in series with a charging diode and in parallel relation to the charging capacitor. The charging coil and the primary and secondary ignition coils are located on the same leg of a core. To avoid a flux linkage between the charging coil and the ignition coils during ignition, the charging coil is magnetically separated from the primary and secondary ignition coils by providing a physical spacing of the coils on the core leg. The Phelon et al. U.S. Pat. No. 4,285,321 discloses an arrangement similar to that of the Burson patent in which the charging and ignition functions are performed by three coils and in which a trigger voltage is derived from the secondary ignition coil, rather than from the primary ignition coil. The Carlsson et al. U.S. Pat. No. 4,181,114 shows a four coil arrangement in which a charging coil is disposed on one outer leg of an E-shaped core, primary and secondary ignition coils are disposed on a middle leg of the core and a trigger coil on the the other outer leg of the core. The Carlsson et al. circuitry is unlike that of the Foreman et al. Burson and Phelon et al. patents in that a series circuit is formed by the primary coil, a capacitor, a diode and the charging coil. Isolation between the primary ignition coil and the charging coil is obtained by their location on separate core legs.

Various circuit features are incorporated in the systems of aforementioned patents and in those of other prior patents which relate to capacitor discharge ignition systems. For example, the aforementioned Foreman et al. patent discloses a protective device and a diode connected across the primary winding. The aforementioned Carlsson et al. patent discloses a varistor connected across a charging coil to limit the voltage thereacross and to protect a charging diode against an excessive inverse voltage. The Bodig U.S. Pat. No. 3,703,889 shows a reversing diode to prevent reverse charging of an ignition capacitor, and shows voltage divider circuitry connected to the gate of a thyristor used to dishcarge the capacitor. The Bodig patent also shows a voltage-dependent resistor across a charge coil. The Burson U.S. Pat. No. 3,955,549 and the Burson U.S. Pat. No. 4,033,311 show reverse-poled diodes across charging coils and the Anderson et al. U.S. Pat. No. 3,960,128 shows a reverse-poled diode across a a SCR. The Carmichael U.S. Pat. No. 4,056,088 shows a series circuit of a shunting diode and shunting resistor connected across a charging coil and the Carmichael U.S. Pat. No. 4,170,977 shows a diode connected across a charging coil. The Höhne et al. U.S. Pat. No. 3,500,809 shows a protective diode for assuring that only positive control signals are applied to the control electrode of an electronic switch. The aforementioned Foreman U.S. Pat. No. 3,545,420 also shows a diode for a similar purpose.

Arrangements such as disclosed in the prior art have been used commercially with some degree of success but have left much to be desired, particularly with respect to performance, relibility and cost of manufacture.

SUMMARY OF THE INVENTION

This invention was evolved with the general object of providing improved capacitor ignition systems providing performance superior to that obtained by prior art devices, while also being reliable and trouble-free in operation and being economically manufacturable.

Important aspects of the invention relate to the discovery and recognition of the sources of problems with prior art systems and to analyses of the problems to provide solutions thereof. A two coil arrangement such as disclosed in the aforementioned Foreman et al. patent has problems in practical implementation in that an inverse voltage is applied to the charging diode which is the sum of the charge of the capacitor and the voltage developed across the charging coil which is also used as secondary ignition coil so that a very high voltage is developed thereacross during ignition. Diodes which can withstand high inverse voltages are not available at reasonable cost and thus such a system would be either lacking in performance, unreliable or unduly expensive to manufacture.

The aforementioned three and four coil systems have the disadvantage that the addition of coils increase the size and cost of the system. In addition, in systems in which all coils are on one core and particularly on one leg of a core, reinduced voltages can lead to destruction of the charging diode even with separation the coils.

This invention is therefore based on the problem of designing a capacitor ignition system of the type described hereinbefore and improving it so that it provide equal or superior performance and at the same time can be built at a lower cost and also be be more reliable in operation.

To solve this problem, it is proposed according to this invention that the charging coil be part of the ignition coil in an arrangement which is such as to realize cost and other advantages of minimizing the number of coils while also obtaining excellent performance and avoiding excessive inverse charging diode voltages and other problems.

In one embodiment of a system constructed in accordance with the invention, one ignition coil is connected through a charging diode to a capacitor and is provided with an intermediate tap to divide it into first and second sections with an electronic switch being connected in series with the charging diode to the first section to be in parallel relation thereto while the second coil section forms the primary ignition coil and may be coupled to a control electrode of the electronic switch to control its conduction and initiate a capacitor discharge and ignition operation.

In contrast with the aforementioned prior art ignition systems, the two coil sections connected in series contribute to charging of the capacitor so that the second section, which forms the primary ignition coil also contributes to the charging of the capacitor whereas with prior art systems, coils are arranged in separate parallel branches to a charging capacitor or are otherwise so connected that the voltage induced in a primary winding or coil cannot contribute anything at all to charging of the capacitor during the charging phase.

This yields a substantial advantage from a reduction in the total number of windings of the charging coil and ignition coil even taking into account the fact that in practice the two sections of the ignition coil with a great difference in number of windings usually also have wires of different diameters. Thus, for example, the second section of the coil which forms the primary winding may only have 50 turns of wire with a diameter about 0.5 mm, while the first section of the coil may preferably have on the order of 2000 turns and a diameter of only 8 mm. Nevertheless, the fact remains that with a practical example as described, a voltage produced by 2050 turns from passage of a magnet in a path in proximity thereto is available for charging the charging capacitor whereas with prior art designs, a charging coil with 2050 turns plus an additional primary coil with 50 turns would be necessary to produce a charging voltage of the same magnitude.

Specific features of the invention relate to the the connection of components in circuit with the aforementioned coil sections in a manner such as to overcome problems encountered with prior art systems and/or which might otherwise occur. In accordance with one important feature, a reversing diode is connected across the first coil section which is connected in series with the charging diode in parallel with the electronic switch. Teversing diode short-circuits negative voltage peaks induced by ignition in this first coil section. Since the coil sections are all part of ignition coil on a common core of ferromagnetic material, a high voltage is induced in the charging coil during the ignition phase when the capcitor is discharged through the second coil section. In the absence of the reversing diode, the negative voltage peaks at the anode of the charging diode might amount to more than 5000 volts, which would destroy the charging diode. Diodes that can withstand a voltage of more than 5000 V are not commercially available, but even if they were, their structural size (not to mention the cost) would prevent their installation in a capacitor ignition system of the type to which this invention relates. In the system of this invention, these problems can be minimized very simply by means of the additional reversing diode.

Another problem addressed by the invention relates to the design of the ignition circuit of the electronic switch which is preferably a thyristor. As aforementioned, the second coil section which forms the primary ignition coil may be coupled to a control electrode of the electronic switch to control its conduction and initiate a capacitor discharge and ignition operation. With a direct coupling of the primary ignition coil so formed by the second coil section to the gate cathode segment of a thyristor, the positive and negative voltage pulses greater than 10 V that occur at the primary ignition coil are also applied to the gate of the thyristor. However, a negative voltage of more than 10 V is far above the maximum allowed negative voltage which, according to leading manufacturers for such thyristors, is in the range of from 5 to 8 volts. Thus there is the danger of destruction of the thyristor.

In order to overcome these problems, another specific feature of this invention is in the provision of a coupling circuit such that the gate of the thyristor is connected to an intermediate point of a voltage divider which is connected in parallel with the second coil section, the voltage applied to the gate electrode being thereby reduced to a safe value. In one form of coupling circuit, a resistive voltage divider is used. In a modified form of coupling circuit, which has been found to be especially advantagous, a diode is included in the gate-cathode section of the voltage divider to short-circuit any negative voltage greater than a quite low value of on the order of 1 volt or less.

In a second embodiment of the invention, one ignition coil is used as a primary coil and a second ignition coil has an intermediate tap to divide it into first and second sections, the first section being used in a capacitor-charging operation and the two sections being used together in forming a secondary ignition coil. Thus the first section not only performs a charging function but also contributes to the output voltage produced during discharge of the capacitor in the ignition phase. However, it is found that the number of turns of the first section need only be a fraction of the total number of turns of the two sections, so as to limit the voltage across the first section and thereby limit the inverse voltage applied to the charging diode during ignition. In accordance with a specific feature, the inverse voltage is further limited by the provision of a varistor across the first section, operative to limit the inverse voltage across the charging diode to a safe value which may the on the order of 1000 to 2000 volts. It is found that although the varistor, in reducing the allowable voltage across the first section, may reduce to some degree the total output ignition voltage developed across the first and second sections together, the reduction is relatively minor from a practical standpoint and the first section still makes a substantial contribution to producing the desired high output ignition voltage.

A specific feature of the second embodiment is in the provision of a reverse-poled diode in parallel relation to the electronic switch which is preferably a thyristor. The diode operates to insure an uninterrupted damped oscillation during the ignition phase and to insure a long burning time which may be on the order of five times that which would be obtained without the diode.

Another important feature of the second embodiment is in the provision of a connection between the primary ignition coil and the tap of aforementioned secondary ignition coil, such that the primary ignition coil cooperates with the charging coil section of the secondary ignition coil in the capacitor charging operation as well as performing its function of operating in the ignition phase to develop a rapidly changing magnetic flux from the discharge current. In particular, the primary coil is connected in series with the capacitor, the charging diode and the first coil section, preferably with the charging diode and the capacitor being connected in series between the tap of the secondary ignition coil and one end of the primary winding. Thus the first coil section performs functions in both the charging and ignition phases of the the operation and the primary coil section performs functions in both of such phases as well. The overall result is that the total number turns in the coils is substantially reduced with a corresponding reduction in the physical size of the ignition coil. At the same time, the performance of the system is increased, while the components are protected against excessive voltages to obtain safe, reliable and trouble-free operation. The cost of manufacture is also reduced.

As aforementioned in connection with the first embodiment, the primary ignition coil thereof may be coupled to a control electrode of the electronic switch to control its conduction and initiate a capacitor discharge and ignition operation and a similar arrangement may preferrably be used in the second embodiment. At very high speeds, ignition may be delayed with such arrangments to adversely affect operation. In order to achieve early ignition with an increase in speed, a separate trigger coil may be used for initiating conduction, of a type known by itself in the prior art. Such a separate coil may be located on a leg of the core of the ignition coil assembly which is separate from the leg on which the aforementioned coils are provided which serve the charging and the primary and secondary functions.

This invention contemplates other objects features and advantages which will become more fully apparent from the following detailed description taken in conjunction with the accompanying drawings.

DESCRIPTION OF PREFERRED EMBODIMENTS

Figure 1:
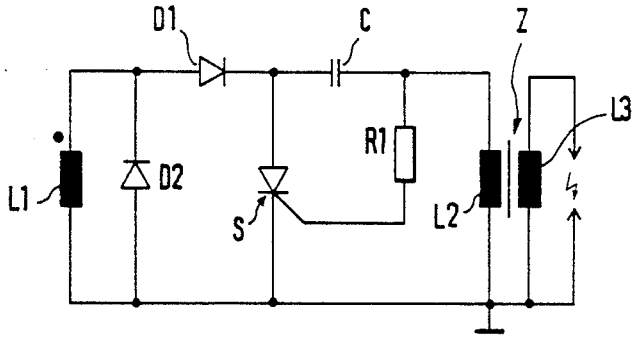
FIG. 1 a schematic circuit diagram of a first embodiment a capacitor ignition system according to the invention in which a charging coil forms part of the ignition coil.

FIG. 1 shows a first preferred embodiment of a capacitor ignition system constructed in accordance with the principles of the invention and including an ignition coil which is generally designated by reference character Z and which is arranged to be positioned in proximity to the path of movement of a magnet, not shown, which may be carried from the shaft of an engine. The ignition coil Z includes a core of ferromagnetic material and a first coil section L1, a second coil section L2 and a third coil section L3 all three of which are wound on a common portion of the core. In the general operation of the system, the engine- driven magnet develops a changing field in the core of the ignition coil Z and from the energy of the field and through circuity connected to the coil sections L1 and L2, a high ignition voltage is generated across the third coil section L3, which is connected to a spark gap as diagrammatically illustrated.

In the circuit arrangement shown in FIG. 1, one terminal of the first coil section L1 is connected to ground and the other is connected through a charging diode D1 and a capacitor C to one terminal of the second coil section L2, the other terminal of section L2 being connected to ground so that the sections L1 and L2 are connected in series relation. An electronic switch S, preferably a thyristor as shown, has its cathode connected to ground and its anode connected to the junction between the cathode of diode D1 and the capacitor. A resistor R1 is connected between the gate of the thyristor switch S and the ungrounded end of coil section L2. A reversing diode D2 is connected between the opposite terminals of coil section L1.

In the operation of the system, a change in one direction of the magnetic field in the core of the ignition coil Z induces a voltage in the coil section L1 such that the ungrounded terminal thereof is of positive polarity. At the same time a voltage is induced in the section coil section L2 having a polarity such that the grounded end thereof is positive. Such induced voltages in the coil sections L1 and L2 are combined in series aiding relation to charge the capacitor with a polarity such that the terminal connected to the anode of the switch S is positive. When the magnetic field in the core of the ignition coil Z changes in the opposite direction, a voltage is induced in the second coil section L2 of opposite phase and having a polarity such that the ungrounded end thereof is positive, such voltage being applied through the resistor R1 to the gate of the thyristor switch S to initiate conduction of the thyristor at a certain time. The capacitor C is then rapidly discharged through the second coil section L2 and a high voltage is developed in the third coil section L3 connected to the spark gap as shown.

To develop the desired high voltage, the ratio of the number of turns in the coil section L3 to the number of turns in the coil section L2 is preferably quite large, on the order of 1000 to 1. Thus, the coil section L2 may desirably have a relatively few number of turns such as 50 turns for example. To develop the required charging voltage, the number of turns of the coil section L1 may preferably be substantially larger than the number of turns in the coil section L2 while being considerably less than the number of turns in the coil section L3. For example, the number of turns of the coil section L1 may be on the order of 2000.

Thus, although the coil section L2 makes a substantial contribution to charging of the capacitor C, the principal charging voltage is obtained from the coil section L1 which may therefore be referred to as the charging coil or as constituting charging winding means. The coil section L2, although contributing to performance of the charging function, operates primarily as a primary winding during the capacitor discharge-ignition operation and may therefore be referred to as the primary coil or primary winding means. The coil section operates as a secondary winding of a transformer during the capacitor discharge operation and may therefore be referred to as the secondary coil or secondary winding means.

The reversing diode D2 is conductive during voltage peaks which are induced during conduction of the thyristor switch S and which have a polarity such that the anode of the diode D2 is positive. The result is that the charging diode D1 is protected against excessive inverse voltages which might otherwise destroy the charging diode D1.

Figure 2:
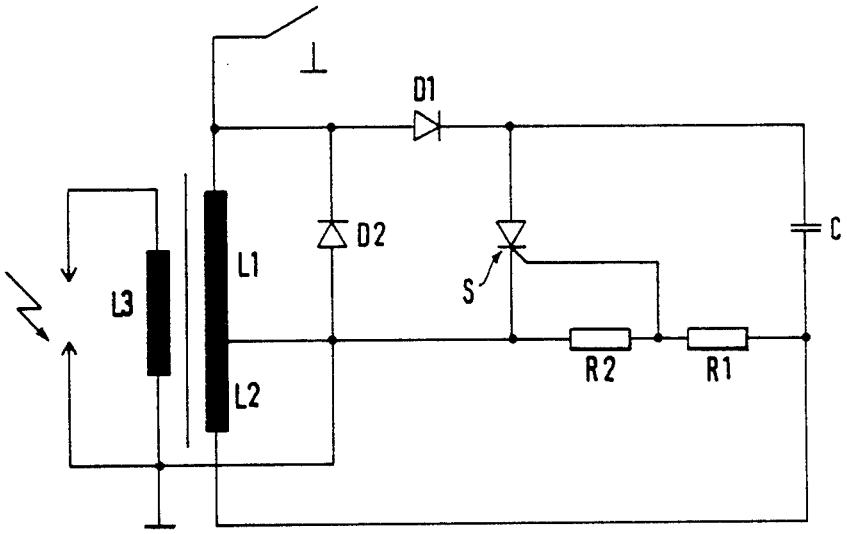
FIG. 2 shows a modified circuit with an improved method of controlling the thyristor, also providing a different representation of the coil arrangement of FIG. 1 to more clearly show that one coil section functions in both charging and ignition phases of operation.

FIG. 2 illustrates a variation of the first preferred embodiment of FIG. 1. The coil arrangement is the same as that of FIG. 1 but it is redrawn to more clearly show the series relationship of sections L1 and L2 in performing the capacitor charging function. As in FIG. 1, the second coil section L2 of the charging coil forms the primary winding, resistor R1 and gate cathode section of the thyristor which forms switch S. The arrangement of FIG. 2 differs from that of FIG. 1 in that the gate of the thyristor S is connected to the tap of a voltage divider which is formed by resistor R1 and a second resistor R2 and which is connected across the coil section L2. With this variation, the voltage which can be applied to the gate of the thyristor S during ignition is reduced, to avoid problems which might occur with the arrangement of FIG. 1 in which the resistor R2 is not provided. With ignition of the thyristor, positive and negative voltage pulses that are greater than 10 V can occur across the coil section L2 which forms the primary winding. Thus a negative voltage of more than 10 V, which is too high for most commercial thyristors, might also applied at the gate of the thyristor with the circuit of FIG. 1. The voltage divider of FIG. 2 divides down such negative voltages in accordance with the selected resistance ratio and minimizes such problems.

Figure 3:
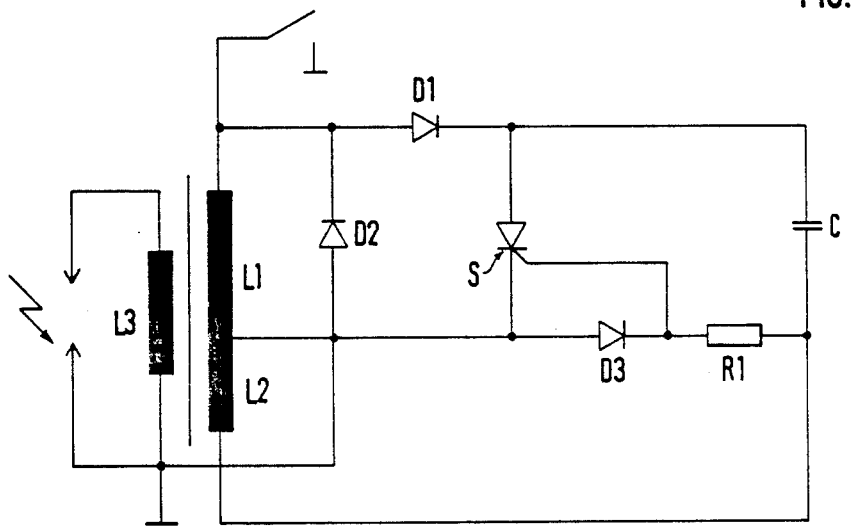
FIG. 3 shows a modification of the thyristor control system according to FIG. 2.

Another advantageous variation of the first embodiment of FIG. 1 is shown in FIG. 3. Instead of the resistor R2 of the voltage divider circuit according to FIG. 2, a diode D3 is provided which short circuits negative voltages greater than a certain value, about 1 volt, for example, to insure against application of an excessive negatave voltage to the gate electrode of the thyristor S.

Figure 4:
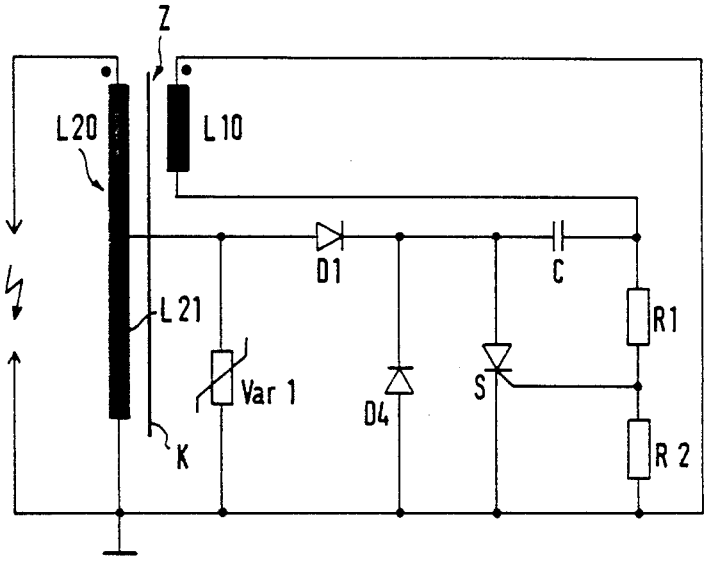
FIG. 4 is circuit diagram of a second preferred embodiment of a capacitor ignition system of the invention in which a section of an ignition coil functions both as a charging coil and as part of a secondary ignition coil and in which a primary functions in a charging phase as well as in an ignition phase.

FIG. 4 is a circuit diagram of a second preferred embodiment of a capacitor ignition system constructed in accordance with the principles of the invention. An ignition coil Z includes coil sections L10, L20 and L21 on a common core K of magnetic material. The coil sections L20 and L21 are connected in series to a spark gap as illustrated and may be regarded as a single coil having a tap. The tap so provided, i.e. a junction between coil sections L20 and L21 is connected through the charging diode D1 and through the capacitor C to one end of the coil section L10, the opposite end of which is connected to ground with the ungrounded lower end of the coil section 21 being also connected to ground. The thyristor switch S is connected between ground and the junction between charging diode D1 and capacitor C. The gate of the thyristor switch S is connected to the tap of a voltage divider formed by the resistors R1 and R2 and connected across the coil section L10. A reversing diode D4, in this embodiment, is connected in direct parallel relation to the thyristor switch S. A varister VAR1 is connected across the coil section L21.

The coil section L10 operates principally as a primary winding during the ignition phase and may be referred to as a primary coil or primary winding means but, like the coil section L2 of the embodiment of FIGS. 1-3, the coil section L10 also operates as part of a charging winding formed by it and the coil section L21, since it contributes to developing the desired charging voltage across the capacitor C. The coil section L20 operates as a principal part of a secondary winding formed by it and the coil section L21 and may be referred to as a secondary coil or secondary winding means. The coil section L21 in this embodiment operates principally as a charging coil or winding means but also operates, in part, as a secondary winding during the ignition phase since it makes a substantial contribution toward producing the desired high output voltage during the ignition phase. Thus each of the three coil sections performs a pincipal function and two of the three coil sections make substantial contributions toward performance of a principal function performed by another of the coil sections. This embodiment thus makes maximum utilization of the coils in performing the required functions.

An important feature is that the Varister VAR1 operates to limit the inverse voltage applied to the charging diode D1 to a safe value while at the same time allowing the coil section L21 to make a substantial contribution toward producing the desired high output voltage.

Figure 5:
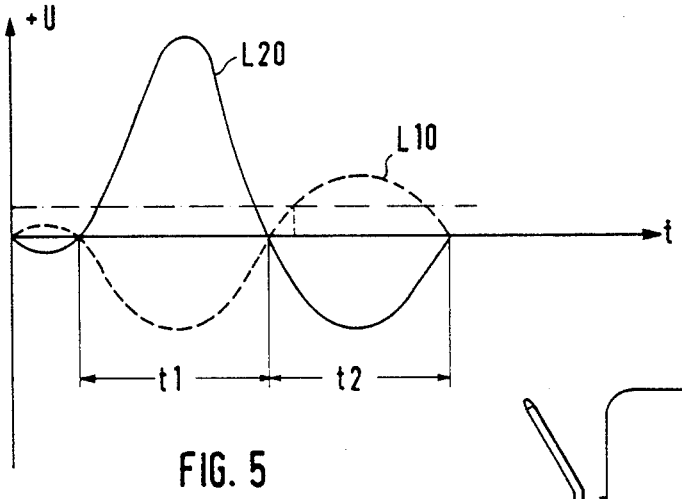
FIG. 5 is a diagram which graphically depicts the variations of voltages induced in the coils in response to rotation of a magnet, as a function of time (disregarding the voltages induced by ignition)

The operation of the circuit of FIG. 4 is depicted graphically in FIG. 5 which illustrates the form of voltages induced in coil sections of the igniton coil Z in response to rotation of a magnet in a path in proximity to the ignition coil Z. The solid line indicates the voltage induced in the coil sections L20 and L21 and appearing at the upper ungrounded end of section L20. The dashed line indicates the voltage induced in the coil section L10 and appearing at its lower ungrounded end. During a time period t1, the capacitor is charged from a combination of a portion of the voltage indicated by the solid line and voltage indicated by the dashed line, such voltages being applied in aiding relation with the illustrated connections. In FIG. 5, the scale of the dashed line voltage is different from that of the solid line voltage to more clearly illlustrate its form, and it should be understood that with turns ratios as discussed hereinbefore, the charge voltage contributed by the coil section L10 and indicated by the dashed line is less than that contributed by the principal charge coil section L21. During a subsequent time period, t2, ignition takes place when the voltage of coil section L1 exceeds a certain threshold value indicated in broken lines in FIG. 5 and determined by the characteristics of the thyristor S and the divider ratio of the divider formed by resistors R1 and R2.

Figure 6:
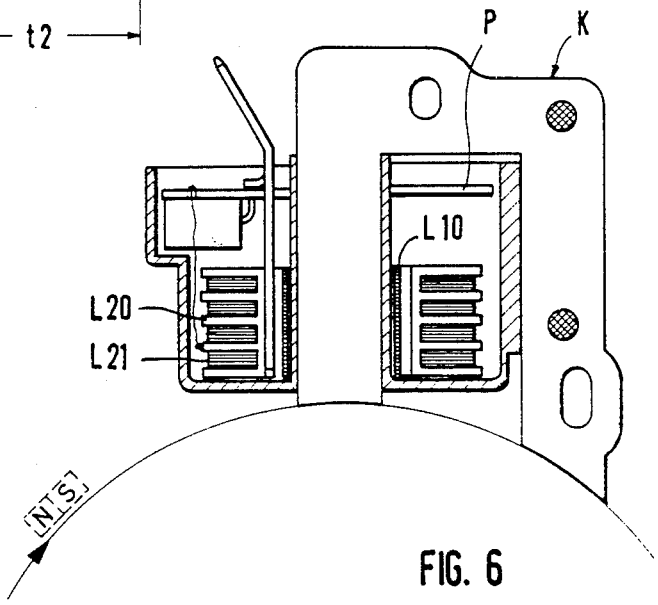
FIG. 6 shows the construction of an ignition coil assembly of the invention, used for the circuit according to FIG. 4, coils and supporting bobbins thereof being shown in cross-section.

FIG. 6 illustrates the physical construction of the ignition coil Z of the embodiment of FIG. 4. The coil sections L20 and L21 are wound on a bobbin as shown, disposed on the outside of the coil section L10 which is wound on one leg of a generally U-shaped core K of ferromagnetic material. The axial extent of the coil sections L20 and L21 is subtantiallly coextensive with that of the coil section L10 to provide relatively "tight" magnetic coupling therebetween. The leads from the coil sections may extend to a board P on which circuit component may be mounted to form a complete assembly. As shown diagrammatically the ends of the two pole portions of the U-shaped core extend to the circular path of movement of a rotating permanent magnet.

Figure 7:
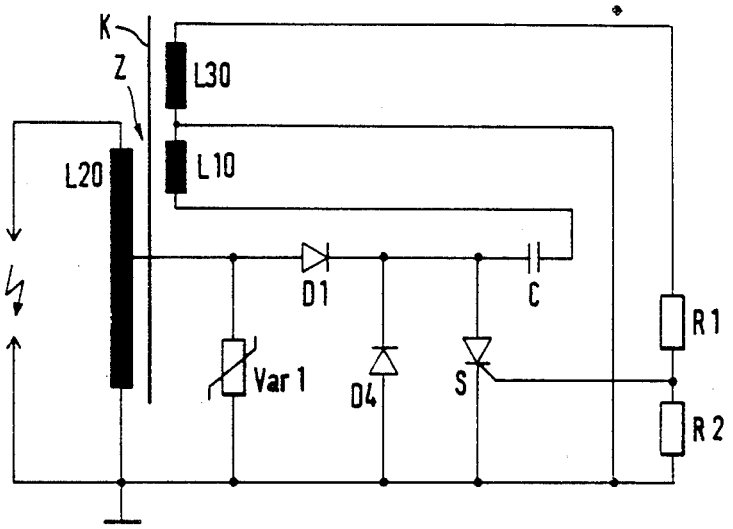
FIG. 7 shows a modification of the circuit according to FIG. 4 with a separate trigger coil for controlling the electronic switch.
Figure 8:
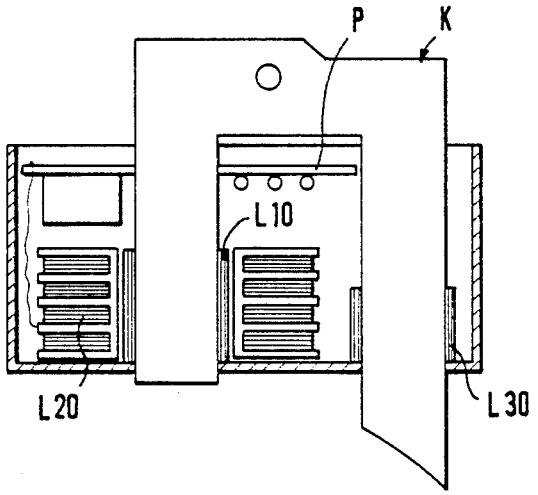
FIG. 8 is a view similar to FIG. 6, but shows the construction of a modified ignition coil assembly used for a circuit according to FIG. 7.

FIG. 7 is a circuit diagram of a variation of the embodiment of FIG. 4 in which the trigger signal for the thyristor S is derived from a separate trigger coil L30. As shown in FIG. 8, the trigger coil L30 is mounted on a leg of the U-shaped core K which leg is separate from the leg on which the coil sections L10, L20 and L21 are wound and which is so positioned that the trigger coil L30 is influenced with a time offset effect by the passing magnet in comparison to the coils L10, L20 and L21 of the ignition coil. The advantage is that trigger coil is relatively unloaded and the voltage thereof increases with an increase in speed, with a leading edge which becomes steeper with an increase in speed so that the ignition time moves in the direction of earlier ignition with an increase in speed.

It will be understood that modifications and variations may be effected without departing from the spirit and scope of the novel concepts of the invention.

What is claimed is:

1. A capacitor ignition system for internal combustion engines, including an ignition coil having a core of magnetic material positionable adjacent a path of a rotating magnet and having winding means on said core to provide a primary winding, a secondary winding and a charging winding, a charging capacitor, a charging diode connected in circuit with said charging winding and said charging capacitor to charge said charging capacitor during a half cycle of one polarity of a voltage induced in said charging winding, and an electronic switch for discharging said charging capacitor through said primary winding during a half cycle of opposite polarity of a voltage induced in said charging winding, characterized in that said secondary winding has an intermediate tap and includes a charging winding section between said tap and one end thereof to provide said charging winding.

2. A capacitor ignition system as defined in claim 1, further characterized in the provision of a varistor in parallel with said charging winding section and operative to protect said charging diode.

3. A capacitor ignition system as defined in claim 1, further characterized in the provision of a voltage divider connected in parallel relation to said charging winding section and in that said electronic switch is a thyristor having a gate electrode connected to an intermediate point of said voltage divider.

4. A capacitor ignition system as defined in claim 3, further characterized in he provision of a varistor in parallel with said charging winding section and operative to protect said charging diode.

5. A capacitor ignition system as defined in claim 2, further characterized in the provision of a blocking diode in parallel relation to said electronic switch.

6. A capacitor ignition system as defined in claim 3, further characterized in the provision of a blocking diode in parallel relation to said electronic switch.

7. A capacitor ignition system as defined in claim 2, further characterized in the provision of a separate trigger winding coupled to said electronic switch and disposed on said core and along said path of a rotating magnet in offset relation to said winding means.

8. A capacitor ignition system as defined in claim 4, further characterized in the provision of a separate trigger winding coupled to said electronic switch and disposed on said core and along said path of a rotating magnet in offset relation to said winding means.

9. A capacitor ignition system as defined in claim 5, further characterized in the provision of a separate trigger winding coupled to said electronic switch and disposed on said core and along said path of a rotating magnet in offset relation to said winding means.

* * * * *